US007338343B2

(12) United States Patent
Siu et al.

(10) Patent No.: US 7,338,343 B2
(45) Date of Patent: Mar. 4, 2008

(54) TOY GRENADE

(76) Inventors: See Lap Siu, Flat G, 14/F, Hoi San Mansion, Riviera Garden, Tsuen Wan, Hong Kong (CN); Kam Luen Hui, RM 'A', 38/F, Block 6, Metro City Phase 1, Tseung Kwan O, N.T., Hong Kong (CN); Lap Shan Lee, Flat/RM 2204, Wing Pak HSE., Hong Pak CRT., Pik Wan Road, Lam Tin, Kowloon, Hong Kong (CN)

( * ) Notice: Subject to any disclaimer, the term of this patent is extended or adjusted under 35 U.S.C. 154(b) by 51 days.

(21) Appl. No.: 11/407,364

(22) Filed: Apr. 20, 2006

(65) Prior Publication Data

US 2007/0249262 A1 Oct. 25, 2007

(51) Int. Cl.
*A63H 33/30* (2006.01)

(52) U.S. Cl. ..... 446/473; 446/401; 102/498; 434/11

(58) Field of Classification Search ..... 446/401, 446/473; 434/11, 12; 102/487, 498; 473/577
See application file for complete search history.

(56) References Cited

U.S. PATENT DOCUMENTS 3,492,945 A * 2/1970 Filippi ..... 102/498
3,878,639 A * 4/1975 Scheelar et al. ..... 446/473
4,319,426 A * 3/1982 Lee ..... 446/401
5,018,449 A * 5/1991 Eidson, II ..... 102/498
5,240,450 A * 8/1993 Graham ..... 446/267
5,246,372 A * 9/1993 Campagnuolo et al. ..... 434/11
5,354,225 A * 10/1994 Hix ..... 446/180
5,590,886 A * 1/1997 Lush ..... 473/577

FOREIGN PATENT DOCUMENTS

CA 587310 * 11/1959

* cited by examiner

*Primary Examiner*—Kien Nguyen
(74) *Attorney, Agent, or Firm*—David W. Wong

(57) ABSTRACT

A toy grenade has a container enclosed in a casing consisting of two separable half oval-shaped casings. The container is filled with a mixture of powder and color dye and compressed air. The top of the container is normally retained by a spring biased elongated rod pressed down by a pivotal handle which is mounted by a removable pull pin. The grenade may be activated by removing the pull pin such that the elongated rod will retract to open the top of the container so that the compressed air will cause two casing halves to separate and the mixture of powder and color dye will spread in the air over the intended target area.

10 Claims, 4 Drawing Sheets

TOY GRENADE

BACKGROUND OF THE INVENTION

1. Field of the Invention

This invention relates to a toy weapon and more particularly to a toy grenade operative for creating a warfare environment in playing a war game 2. Background Art War game is immensely popular among some adults, in which opposing teams of people are dressed in army fatigues and using simulated weapons which can be operated to shoot non-harmful ammunition at one another. The ammunition imposes on the target with a color mark to indicate that the latter having been shot or hurt in a simulated manner. Other simulated weapons may also be used. However, most of the simulated weapons heretofore are unable to provide any effective simulated warfare environment or condition without causing some inherent harm to the players. Also, some toy weapons are complex in construction such that they are costly to fabricate and they are generally self destructive similar to genuine weapons so that they are not re-usable after operated and thus they unnecessarily increase the cost of playing the war game.

SUMMARY OF THE INVENTION

It is the principal object of the present invention to provide a toy grenade which can be operated to create an effective simulated warfare condition.

It is another object of the present invention to provide a toy grenade which are may be re-assembled for further use after operated.

It is another object of the present invention to provide a toy grenade which is simple in construction.

BRIEF DESCRIPTION OF THE DRAWINGS

Other objects of this invention will appear in the following description and appended claims, reference being made to the accompanying drawings forming a part of the specification in which

DETAILED DESCRIPTION OF THE PREFERRED EMBODIMENTS

Figure 1:
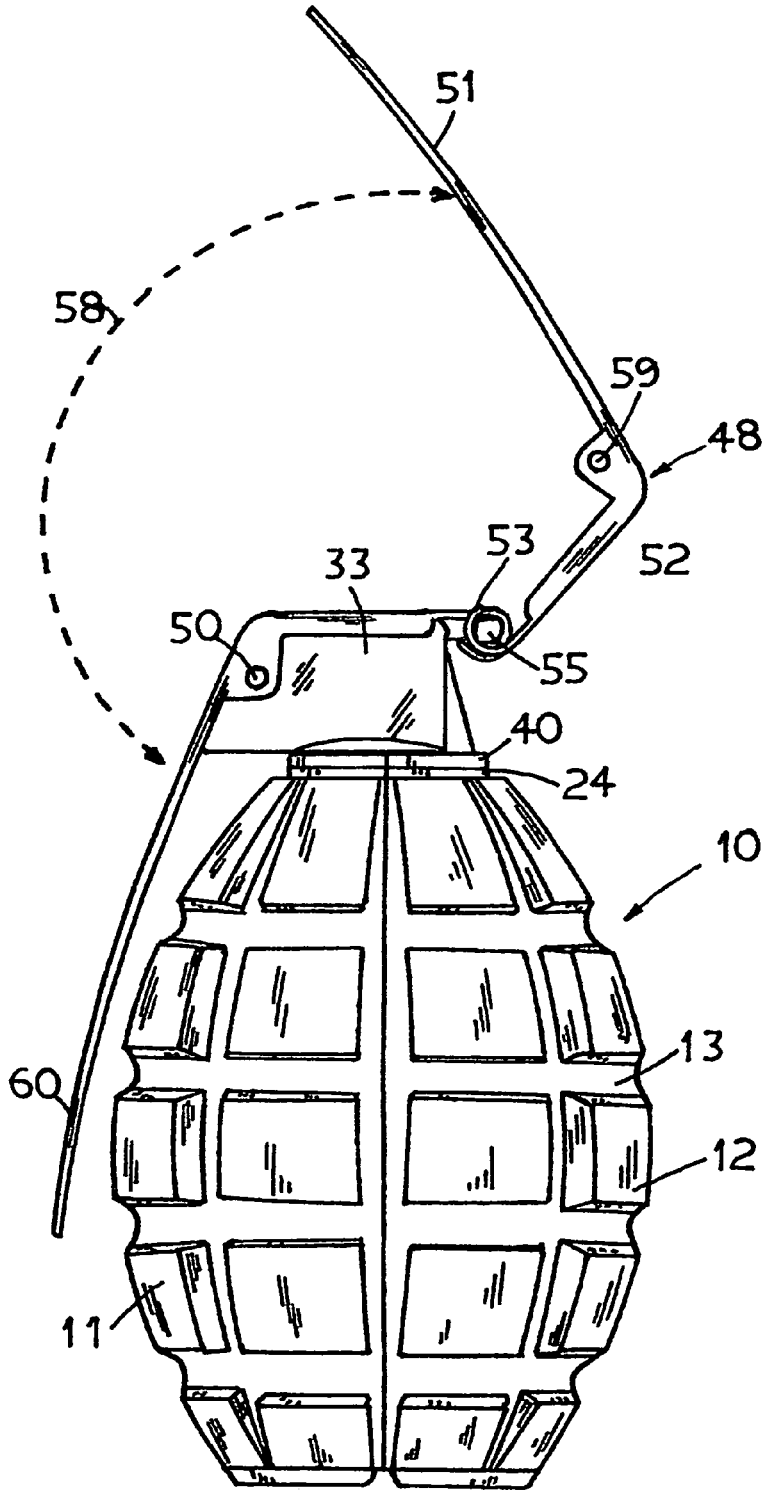
FIG. 1 is side perspective elevation view of the toy grenade of the present invention.
Figure 2:
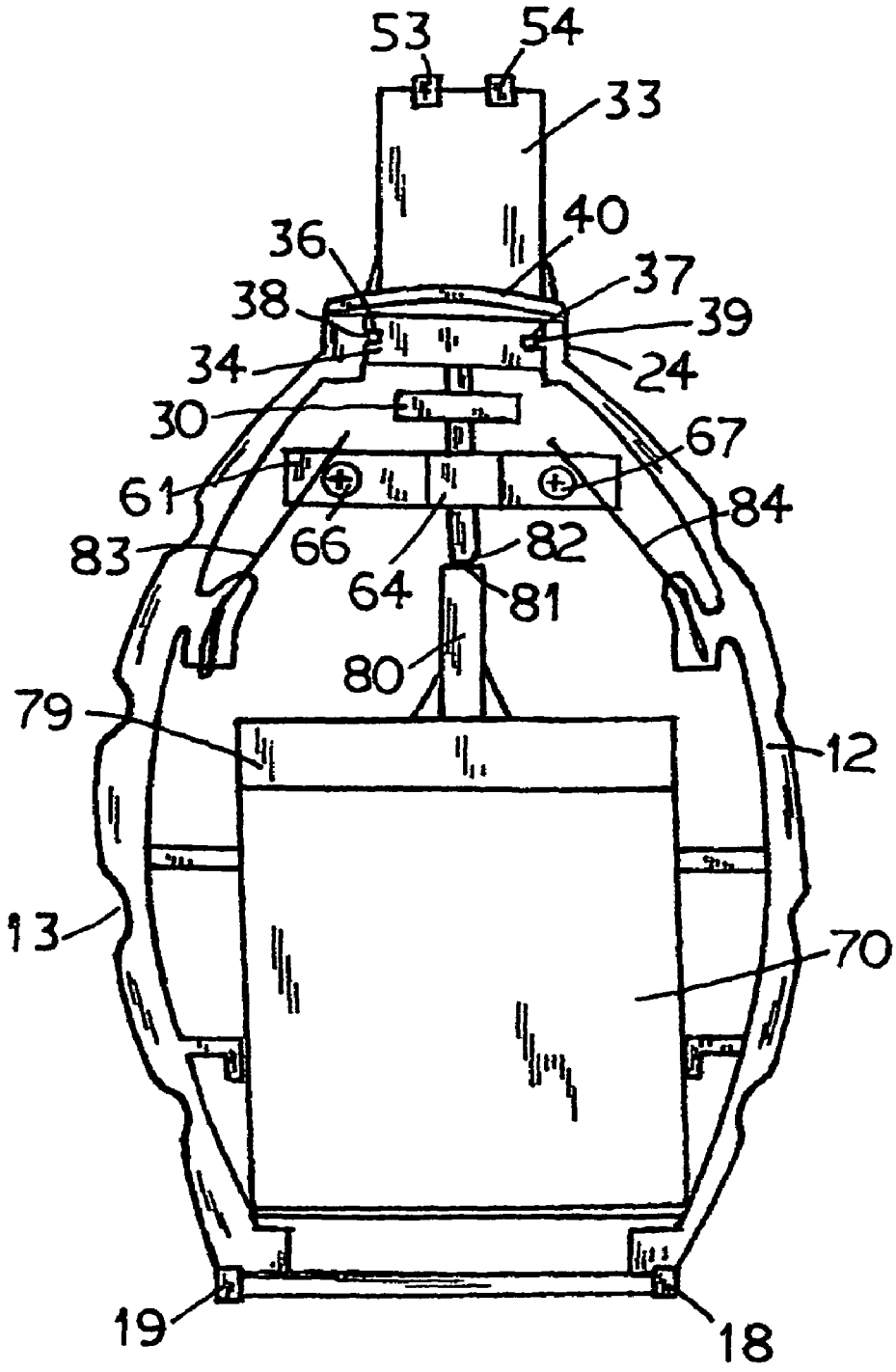
FIG. 2 is a front perspective elevation view of one half of the casing of the toy grenade.
Figure 3:
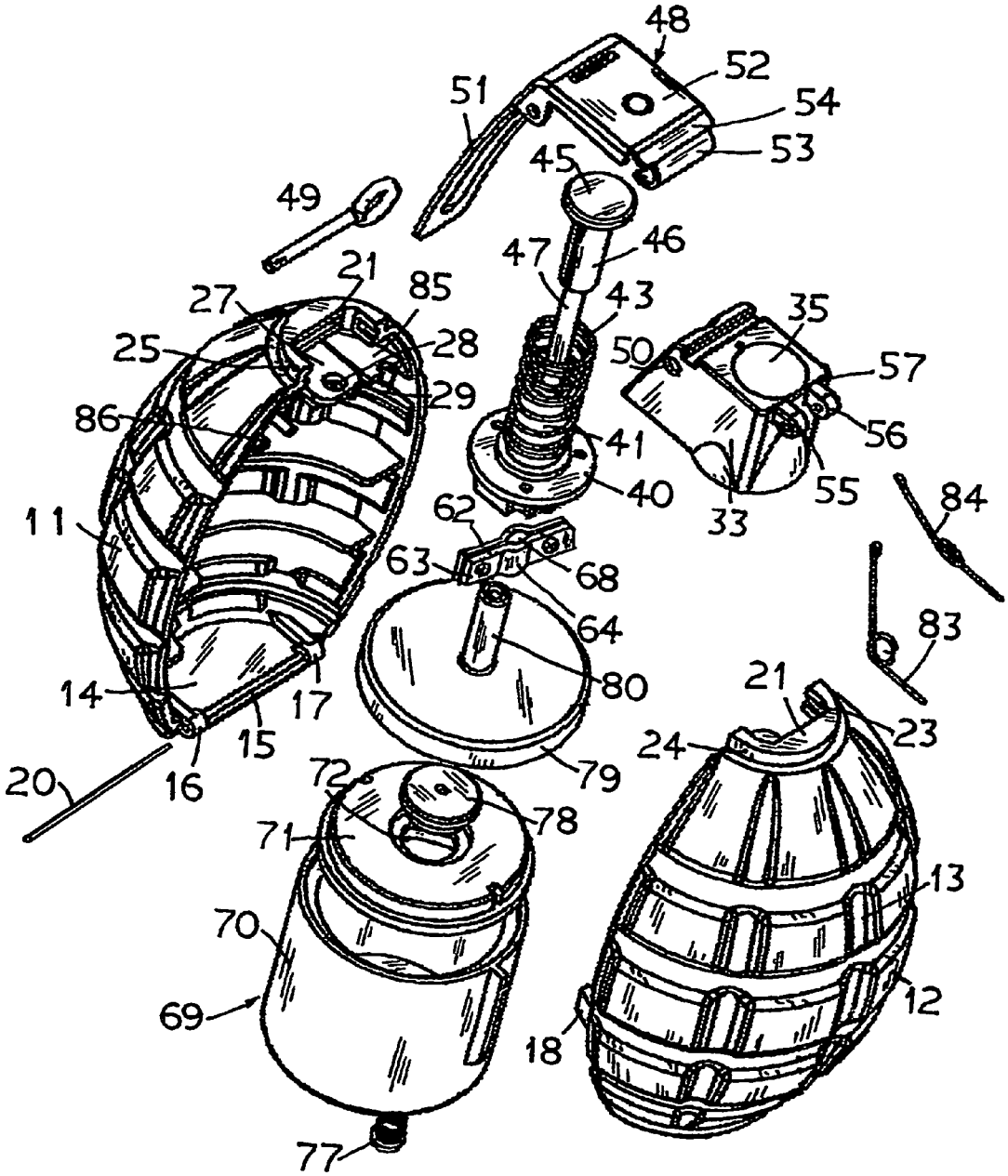
FIG. 3 is an exploded perspective elevation view of the toy grenade of the present invention showing the component parts therein.
Figure 4:
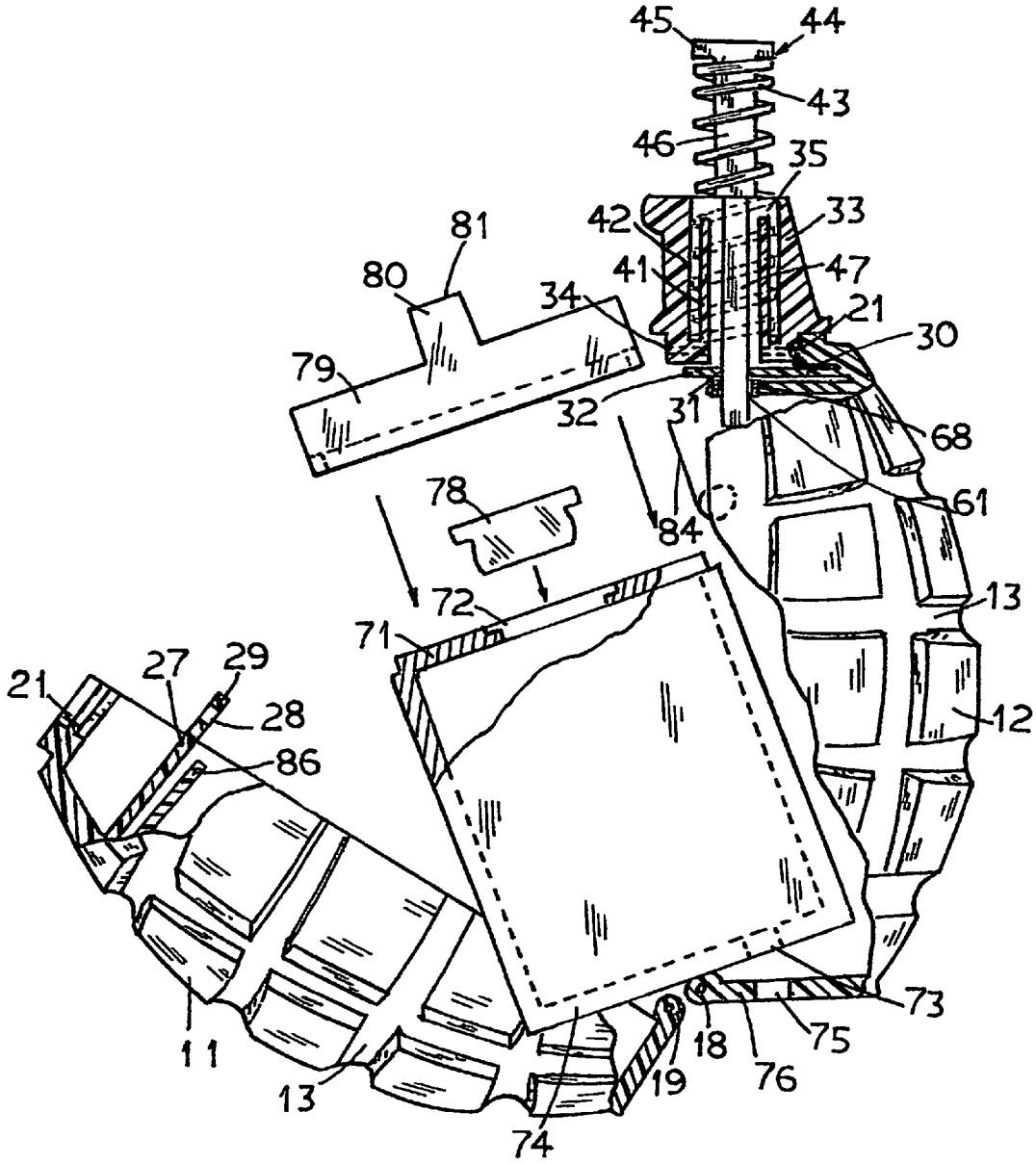
FIG. 4 is a partial sectional side elevation view showing the separation of the component parts after the grenade has been activated.

With reference to the drawings in which like reference numerals designate corresponding parts in the various views, the grenade 10 of the present invention has two generally half oval-shaped casings 11 and 12 which are engageable with one another to form an egg-shaped casing similar to a genuine grenade. Although an egg-shaped shape casing is shown as an exemplary embodiment of the toy grenade, the casing may be of any other shape such as a cylindrical shape similar to that of a conventional genuine grenade. The outer surface of the half oval-shaped casings 11 and 12 may also be provided with a pattern of grooves 13 similar to that of a genuine grenade. The half oval-shaped casing 11 has a closed semi-circular bottom panel 14 with a linear outer edge 15. Engageable hinges 16 and 17 are formed at the lower corners of the outer edge 15 of the half oval-shaped casing 11 and similar hinges 18 and 19 are provided at the lower corners of the outer bottom edge of the half oval-shaped casing 12 such that the two half oval-shaped casings 11 and 12 may be hingedly mounted together at the bottom with a hinge pin 20. The casing 10 may be opened by pivoting the two half oval-shaped casings 11 and 12 apart from one another relative to the bottom hinge mounting. The casing 10 has an upper opening 21 which may be formed by equal U-shaped cut-outs 22 and 23 provided in the half oval-shaped casings 11 and 12 respectively. The opening 21 is surrounded by a short upstanding neck 24 formed by equal semi-circular arcs 25 and 26 formed on the half oval-shaped casings 11 and 12 respectively. A first horizontal support arm 27 is formed in the half oval-shaped casing 11 and it is located at a predetermined distance below the opening 21. A guide opening 28 is located adjacent to the free end 29 of this first horizontal support arm 27. Similarly a second horizontal support arm 30 is formed in the half-oval casing 12 and a second guide opening 31 is located adjacent to the free end 32 of the second horizontal support arm 30. The second horizontal support arm 31 is also located in a spaced manner above the first horizontal arm 27. A cap 33 is mounted at the top of the casing 10. The cap 33 has a square base portion 34 and a vertical through opening 35 extending through its base portion 34. The square base portion 34 has dimensions equal to those of the opening 21 of the casing 10 and its has grooves 36 and 37 formed on two opposite sides therein such that the square base portion 34 is mounted to the top of the casing 10 by slidably engaging the grooves 36 and 37 with ridges 38 and 39 formed in the inside surface of the neck 24 of the casing 10 so as to maintain the cap 33 fixedly mounted in place as well as maintaining the half oval-shaped casings 11 and 12 mounted together at the top. The square base portion 34 has a circular top plate 40 which covers over the top surface of the top opening 21 of the casing 10. A cylindrical sleeve 41 extends vertically upward from the circular top plate 39. The outer cylindrical side wall of the sleeve 41 is spaced from the inner side wall of the through opening 35 of the cap 33 such that a cylindrical space 42 is provided between the sleeve 41 and the through opening 35. A spiral compression spring 43 is slidably located within the cylindrical space 42. The upper end of the spiral compression spring 43 normally extends above the upper edge of the through opening 35. An elongated rod 44 is mounted slidably through the cylindrical sleeve 41. The elongated rod 44 has a top circular push plate 45 having a diameter slightly smaller than the diameter of the through opening 35 of the cap 33 but equal to the outer diameter of the spiral compression spring 43 and it has an upper portion 46 having a diameter equal to the inside diameter of the cylindrical sleeve 41, and a lower portion 47 extending downwards slidably through the guide opening 31 of the horizontal support arm 30.

A generally inverted L-shaped pivot arm 48 is pivotally and removably mounted to the cap 33 by a removable pull pin 49 extending through a horizontal through opening 50 formed in the cap 33. The pivot arm 48 has a handle portion 51 and a flat plate portion 52. A hook-shaped end 53 is formed at the free end 54 of the flat plate portion 52. The hook-shaped end 53 is operable to latch with tabs 55 and 56 located at the top edge 57 of the cap 33 located opposite to the mounting of the pull pin 49. The pivot arm 48 may be mounted to the cap 33 by first latching the hook-shaped end 53 with the tabs 55 and 56 and then pivoted downward as shown by the curved dotted line 58 in FIG. 1 until its mounting openings 59 is aligned with the horizontal through opening 50 of the cap 33 so that the pull pin 49 may then be inserted through the aligned openings to lock the pivot arm 48 at the downward latched position 60. At the downward latched position, the flat plate portion 52 of the pivot arm 48 would press the elongated rod 44 downward to its lowest position with the circular push plate 45 lying within the through opening 35 and the spiral compression spring 43 in a compressed state in the cylindrical space 42.

A slide clamp 61 is mounted in a horizontal position in the half oval-shaped casing 12. The slide clamp 61 consists of two plates 62 and 63 having a curved middle portions 64 and 65 extending outwards opposite to one another. The two plates 62 and 63 are mounted side by side together with mounting and adjustable screws 66 and 67. A vertical through opening 68 is formed between the two curved middle portions 64 and 65 of the plates 62 and 63 when they are mounted together. The lower portion 47 of the elongated rod 44 extends slidably through the opening 68 when the elongated rod 44 is pushed downwards into the cap 33 by the flat plate portion 52 of the pivot arm 48. The lower portion 47 of the elongated rod 44 will also extend through the opening 28 of the second horizontal arm 27 of the half oval-shaped casing 11. The second horizontal arm 27 will position below the slide clamp 61 when the two half oval-shaped casings 11 and 12 are mounted together.

A powder container 69 is located in the casing 10. The powder container 69 consists of a receptacle 70 having a top panel 71. An access opening 72 is formed in the top panel 71 and a filling opening 73 is formed in the bottom panel 74 of the container 69. The filling opening 73 is aligned with an opening 75 formed in the bottom panel 76 of the half oval-shaped casing 12 when the powder container 69 is located within the casing 10. A biased air valve 77 is mounted at the aligned filling opening 73 and opening 75 of the half oval-shaped casing 12. A sealing plug 78 which may be made of rubber material is mountable at the access opening 72 for covering the latter. A spacer cap 79 is placed on top of the powder container 69. An vertical column 80 extends upwards vertically from the top surface of the spacer cap 79. The top end 81 of the vertical column 80 is in contact with the lower end 82 of the elongated rod 44 when the latter is at the lower position.

Two torsion springs 83 and 84 are mounted on the edges of the half oval-shaped casing 12. The free end portions of these torsion springs 83 and 84 will extension into the half oval-shaped casing 11 to engage with the free end edges of two horizontal plates 85 and 86 which will pivot the torsion springs 83 and 84 against their spring force when the two half oval-shaped casing 11 and 12 are mounted together.

In fabrication, the container 69 is filled with colored powder such as wheat powder mixed with a color dye. A compressed air is injected into the container 69 through the air valve 77.

In use, the toy grenade 10 of the present invention is activated by pulling the pull pin 49 out of the cap 33 and then pivoting the pivot arm 48 upwards before throwing the toy grenade 10 to a target location. With the pivot arm 48 pivoted upwards, the elongated rod 44 is no longer pressed down by the flat plate portion 52 of the pivot arm 48, so that the elongated rod 44 will be pushed outwards from the cap 33 by the spring force of the compressed spiral spring 43 and the lower end 82 of the elongated rod 44 will retract upward from the top end 81 of the vertical column 80 of the spacer cap 79. The compressed air within the container 69 will force the sealing plug 78 to separate from the access opening 72. The compressed air together with the spring force of the torsion springs 83 and 84 will cause the half oval-shaped casings 11 and 12 to disengage from one another and the compressed air will cause the colored powder to emit from the container 69 to spread in the air in the target location simulating a warfare condition. The retracting time of the elongated rod 44 may be varied by adjusting the mounting and adjustable screws 66 and 67 to change the clamping force exerting on the elongated rod 44.

After use, the container 70 may be re-filled with a mixture of color dye and powder and the other component parts may then be re-assembled and the container 70 be re-charged with compressed air by injecting it into the container through the air valve 77.

While there have been described and illustrated preferred embodiments of the present invention, it is apparent that numerous alterations, omissions and additions may be made without departing from the spirit thereof.

We claim:

1. A toy grenade comprising:

a casing having two half casings removably mountable together, an elongated rod spring-mounted slidably in said casing and having an end portion therein extendable within said casing by compressing a spiral spring located in said casing, a pivot arm pivotally mounted on said casing and pivotable between a first position and a second position, and at said first position a flat surface portion of said pivot arm pressing said elongated rod to extend within said casing, and at said second position said elongated rod being retracted out of said casing by spring force of said spiral spring, a slide clamp mounted within said casing, said slide clamp having a clamping opening, and said elongated rod being slidably extending through said clamping opening, a powder container located within said casing, and said container having a top panel with an access opening formed therein, said powder container being filled with a colored powder and compressed air, a sealing plug mounted at said access opening, a spacer cap disposed over said top panel of said powder container, said spacer cap having a vertical column therein engageable with a lower end of said elongated rod.

2. A toy grenade according to claim 1 including a cap mounted on said casing, said pivotal arm being mounted on said cap with a removable pull out pin.

3. A toy grenade according to claim 2 wherein said slide clamp retains said elongated rod in a mounted position extending within said casing with an adjustable clamping force.

4. A toy grenade comprising:

a casing having two half oval shaped casings having mounting hinges located at a lower edge therein, said two half oval shaped casings being mountable together at said hinges, a cap mounted on top of said casing, said cap having a vertical through opening, a cylindrical sleeve coaxially located within said vertical through opening in a spaced manner, a spiral spring disposed between said cylindrical sleeve and inner side wall of said vertical through opening of said cap, an elongated rod slidably extending through said cylindrical sleeve, a circular push plate mounted at a top end of said elongated rod and resting on a top end of said spiral spring, said elongated rod being operative to slide up and down said cylindrical sleeve by compressing said spiral spring with said circular push plate, a slide clamp mounted in said casing, said slide clamp having an adjustable clamping opening, and said elongated rod having a lower portion slidably extending through said clamping opening, a pivotal arm removably mounted to said cap with a removable pin, said pivotal arm being pivotable to locate between a first position and a second position, and at said first position said pivotal arm having a flat plate portion pressing said elongated rod downward into said casing against spring force of said spiral spring, and at said second position said flat plate portion being uncovering from said elongated rod whereby said elongated rod retracts outwards of said casing by said spring force, a container located within said casing, said container having a top panel with an access opening formed therein, said container being filled with a color powder and compressed air, a sealing plug removably mounted at said access opening, a spacer cap disposed on top of said container, said spacer cap having a vertical column, and a top end of said column being in contact with a lower end of said elongated rod.

5. A toy grenade according to claim 4 including two tabs formed at a top edge of a side wall of said cap, and said pivotal arm having a hook-shaped mounting formed at a free edge of said flat plate portion therein, said hook-shaped mounting being removably engageable with said tabs.

6. A toy grenade according to claim 5 including a first horizontal guide plate extending in a cantilever manner in one of said two half oval-shaped casings, said first horizontal guide plate having a first free end and having a first guide opening formed adjacent to said first free end, a second horizontal guide plate extending in a cantilever manner in the other one of said two half oval shaped casings and having a second free end with a second guide opening formed adjacent to said second free end, said elongated rod slidably extending through said first guide opening and said second guide opening.

7. A toy grenade according to claim 6 including two torsion springs mounted on said one of said two half oval-shaped casings, and said torsion springs having a pivotal free end portion pivoted by horizontal plates located in said other one of said two half oval-shaped casings against spring force of said torsion springs.

8. A toy grenade according to claim 4 wherein said slide clamp includes two plates mounted side by side by adjustable screws, each one of said plates having a curved middle portion cooperating with one another to form said clamping opening, said adjustable screws being adjustable for varying clamping force of said slide clamp exerting on said elongated rod.

9. A toy grenade according to claim 8 including two torsion springs mounted on an edge portion of one of said half oval-shaped casing, said torsion springs having a pivotable free end extending into the other one of said half oval-shaped casing.

10. A toy grenade according to claim 9 including two abutment plates extending horizontally in a cantilever manner in said other one of said half oval-shaped casing, said abutment plates having a free end pressing against said free end of said torsion springs in said one of said half oval-shaped casing.

* * * * *